United States Patent [19]

Jassniker

[11] 4,265,278

[45] May 5, 1981

[54] VENTILATING SYSTEM FOR A WEAVING MACHINE

[75] Inventor: Kurt Jassniker, Winterthur, Switzerland

[73] Assignee: Sulzer Brothers Limited, Winterthur, Switzerland

[21] Appl. No.: 58,244

[22] Filed: Jul. 17, 1979

[30] Foreign Application Priority Data

Jul. 17, 1978 [CH] Switzerland ..... 7686/78

[51] Int. Cl.[3] ..... D03J 1/02

[52] U.S. Cl. ..... 139/1 C

[58] Field of Search ..... 139/1 C; 57/304; 15/306 A, 405

[56] References Cited

U.S. PATENT DOCUMENTS

| | | | |
|---|---|---|---|
| 3,491,801 | 1/1970 | Lippuner | 139/1 C |
| 3,921,675 | 11/1975 | Filter et al. | 139/1 C |

FOREIGN PATENT DOCUMENTS

| | | | |
|---|---|---|---|
| 524702 | 8/1972 | Switzerland | 139/1 C |

*Primary Examiner*—Henry Jaudon

*Attorney, Agent, or Firm*—Kenyon & Kenyon

[57] ABSTRACT

Weaving machine having a ventilation system preparably for air conditioning, wherein some of the air passing through an air supply duct flows below the warp beam and cloth beam along the floor into the regions around the machine—i.e., more particularly into the operator gangways—and another component of the intaken air is guided inside the machine, more particularly towards the warp, to condition the warp yarns.

9 Claims, 3 Drawing Figures

VENTILATING SYSTEM FOR A WEAVING MACHINE

Figure 1:
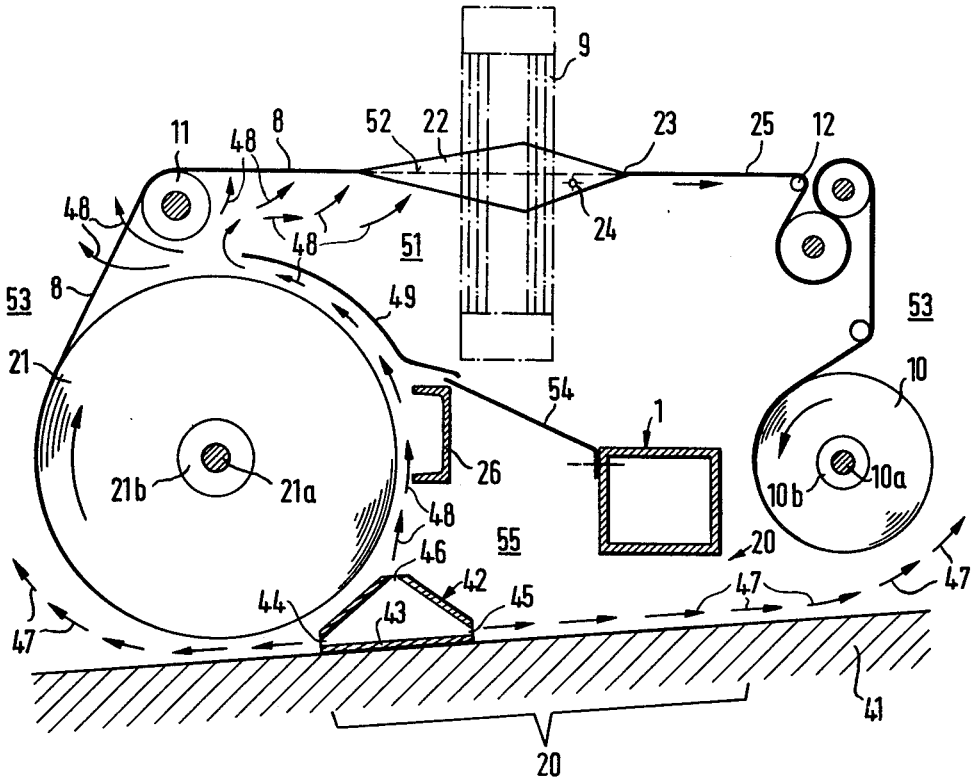

This invention relates to a ventilating system for a weaving machine.

Heretofore, it has been known to provide weaving machines with ventilating systems in the form of air-conditioning facilities. In one case, as described in Swiss Pat. No. 490,549, air has been passed through a duct to near the warp yarns and then issued through exit orifices into a space below the warp. As the warp and the cloth which is being produced form a kind of top closure member, the only way for most of the entering air to issue is past the two ends of the machine. In such cases, a special separate air-conditioning facility is used to air-condition the weaving room or premises.

Accordingly, it is an object of the invention to provide a weaving machine with a ventilating system capable of air-conditioning the area about the machine.

It is another object of the invention to simultaneously ventilate a weaving machine and air-condition the area at at least one end of the weaving machine from a single source.

Briefly, the invention is directed to a weaving machine having a machine frame, a warp beam mounted at one end of the frame, a cloth beam mounted at an opposite end of the frame and means for directing warp yarns from the warp beam through a weaving plane to the cloth beam. In accordance with the invention, the weaving machine is provided with a ventilation system comprising at least one air supply duct below the weaving plane between the warp beam and cloth beam. The duct has one set of apertures for directing a first flow of air below at least one of the warp beams and cloth beams to an area outside and adjacent the respective end of the machine as well as a second set of apertures for directing a second flow of air into the interior below the weaving plane.

The air which flows below the warp beam and/or cloth beam particularly reaches into an area where a machine operator has to work, for example, an operator gangway in the weaving room. The remainder of the intaken air can be used to condition the warp yarns and/or clean the machine. Consequently, an air supply is used only in the region near the bottom of the weaving machine, i.e. near the floor where ducting can be fitted more readily than elsewhere. An air supply duct immediately below the weaving plane is not required.

In one embodiment, the air duct is of triangle cross-section with the sets of apertures disposed at a respective vertex.

In another embodiment, the air duct is a hollow bearing member of the machine frame. In this case, at least one guide plate is secured to the bearing member to separate the sets of apertures from each other.

In another embodiment, a hollow bearing member of the machine frame is sub-divided into an air supply duct with two sets of apertures and an air exhaust duct having a third set of apertures in communication with the interior of the machine.

Figure 2:
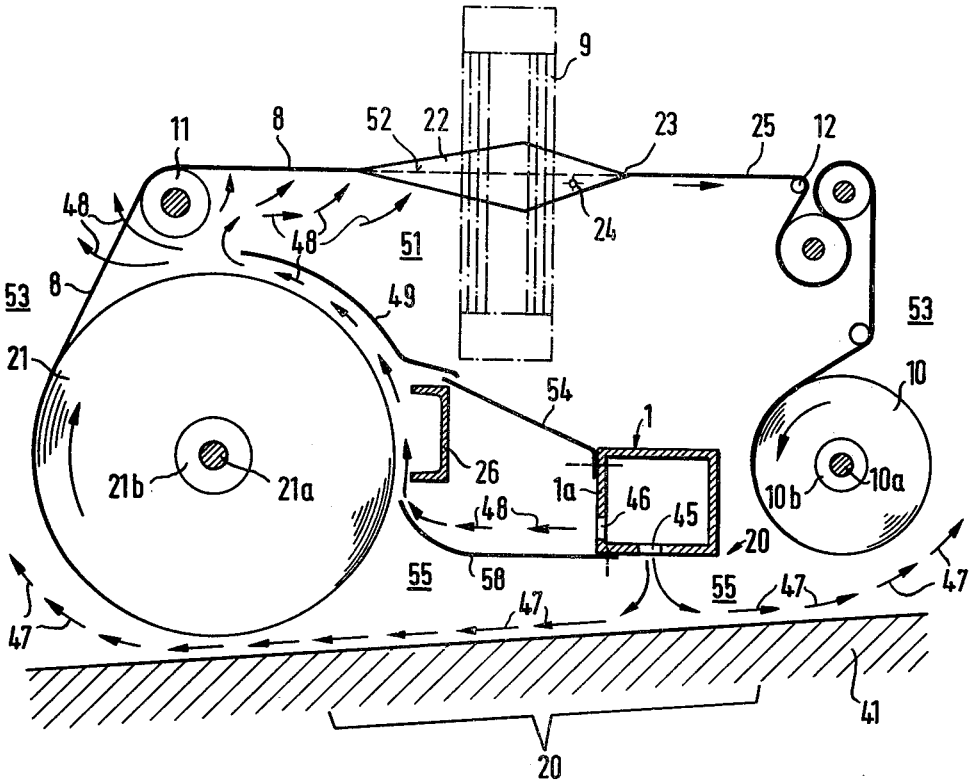
Figure 3:
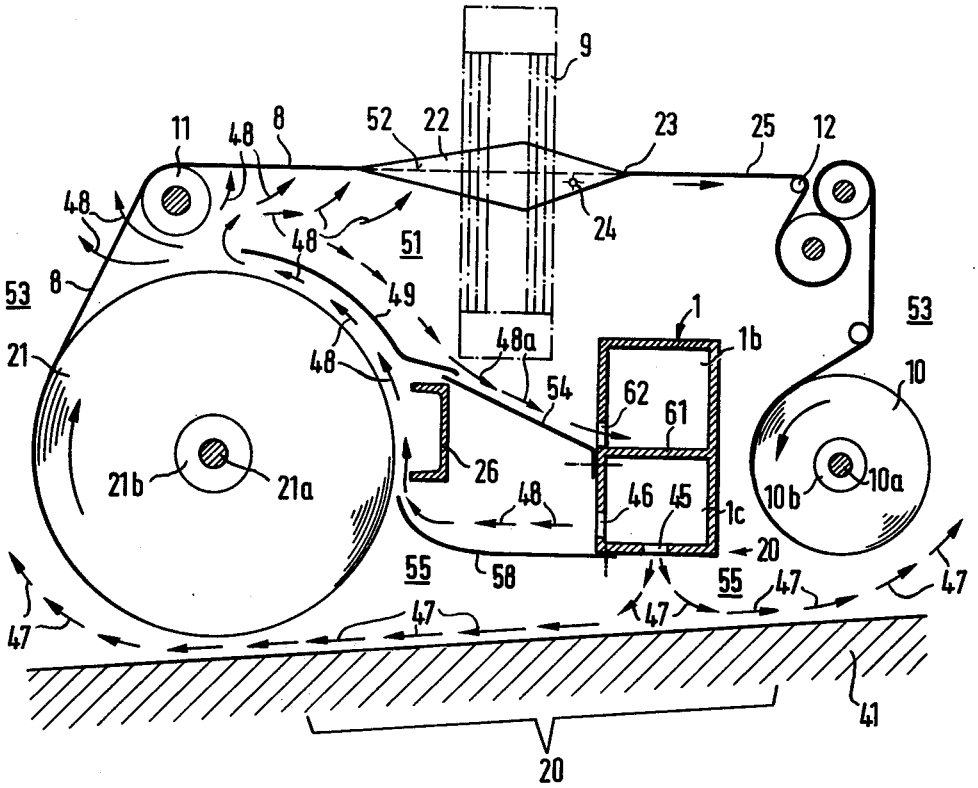

These and other objects and advantages of the invention will become more apparent from the following detailed description taken in conjunction with the drawings wherein:

FIG. 1 diagrammatically illustrates a sectional view of a weaving machine having a ventilating system according to the invention;

FIG. 2 illustrates a view similar to FIG. 1 of a weaving machine having a modified ventilating system in accordance with the invention; and FIG. 3 illustrates a view similar to FIG. 1 of a weaving machine having a further modified ventilating system according to the invention.

Referring to FIG. 1, the weaving machine has a machine frame formed in part by a main bearing member or girder 1 of hollow box construction and a channel-shaped bearing member or girder 26. The machine frame has means (not shown) at one end for mounting a warp beam 21 thereon as well as means (not shown) at the opposite end for mounting a cloth beam 10 thereon. As shown, the warp beam 21 has a shaft 21*a* and tube 21*b* while the cloth beam 10 has a similar shaft 10*a* and tube 10*b* for mounting purposes. The machine also has means for directing warp yarns 8 from the warp beam 21 over a tensioning beam 11 through a weaving plane 52 for weaving into a cloth 25 which is then passed over a breast beam 12 and other rollers for take-up on the cloth beam 10. Suitable means, such as heddles 9, are provided in the weaving plane to form a weaving shed 22 and a reed (not shown) is provided to beat up a weft yarn picked along a picking path 24 into the cloth at a fell 23. As shown, the bearing members 1, 26 are parallel to the picking path 24. The weaving machine may also be covered at the top.

A ventilation system is provided for the weaving machine and includes an air supply duct 42 in a region 20 below the weaving plane between the warp beam 21 and cloth beam 10. The duct 42 extends transversely of the weaving plane 52 parallel to the warp beam 21 and is of triangular cross-section with a base 43 parallel to and resting on a floor 41 on which the weaving machine is mounted. The duct 42 has a set of apertures 44, 45, 46 disposed at each vertex for exhausting air supplied to the duct 42 from a suitable source (not shown).

As shown, a deflector plate 49 is disposed above the warp beam 21 and below the weaving plane 52 to direct a flow of air from the duct 42 over the circumferential periphery of the warp beam 21.

When in use, air issues from the duct 42 via the apertures 44, 45 and flows along the floor 41, as indicated by arrows 47, below the beams 21, 10 and through into the weaving room or premises 53 and particularly to the areas outside and adjacent the ends of the machine. In addition, air issues from the apertures 46 and rises in the direction indicated by arrows 48, to be guided by the deflector plate 49 along the warp beam 21. Near the tensioning beam 11, the air from the apertures 46 enters the space 51 below the warp yarns 8 and the weaving plane 52.

The air used to condition the weaving room 53 particularly conditions the operator gangways (not shown), the place where an operator is most of the time when working on the machine.

A deflector plate 54 can also be disposed on the main bearing member 1 to deflect the machine-conditioning air towards the warp beam 21 in the direction indicated by arrows 48. The plates 49, 54 also separate the space 51 below the weaving plane 52 from the bottom space 55 between the warp beam 21 and cloth beam 10.

Referring to FIG. 2, wherein like reference characters indicate like parts as above, the main bearing member may alternatively function as the air supply duct of the ventilating system. In this case, the member 1 which has a horizontally disposed base above the floor 41 has a set of apertures 45 in the base to direct a flow of room-conditioning air at the floor 41 to thereafter separate and then flow, as indicated by arrows 47, under both the warp and cloth beams 21, 10. The member 1 also has a set of apertures 46 in a vertical sidewall 1*a* to direct a flow of machine-conditioning air towards the warp beam 21. A deflector plate 58 is secured to the base of the member to separate the apertures 45, 46 and extends towards the warp beam 21 with an upturned end. The machine-conditioning air is thus guided between the plates 58, 54 as indicated by arrows 48 to and upwardly along the warp beam 21.

Referring to FIG. 3 wherein like reference characters indicate like parts as above, the bearing member 1 is subdivided by a partition 61 into an air supply duct 1*c* and an exhaust duct 1*b*. The air supply duct 1*c* has two sets of apertures 45,46 for the room-conditioning air (47) and machine-conditioning air (48). The air exhaust duct 1*b* has a set of apertures 62 for exhausting air from the space 51 in the interior of the machine. This air flows in the direction indicated by the arrows 48*a*.

In all the embodiments, the air supply duct 42, 1, 1*c* serves the two purposes of supplying air for conditioning to both the premises and the machine (two-zone conditioning). If required, an air duct can also be provided above the weaving plane 52. The shed-conditioning air associated with the arrows 47 and that proportion of the machine-conditioning air which issues from the machine as indicated by arrows 48 can be extracted, e.g. by an additional conditioning facility (not shown) disposed e.g. in the ceiling of the weaving room.

Ordinary unconditioned fresh air for renewing the air in the weaving room 53 and for cleaning the space 51 inside the machine can also be supplied through the air supply duct 42, 1, 1*c*.

Another variant can be provided if e.g. in the construction shown in FIG. 1, the duct 42 is formed only with the apertures 44 or only with the apertures 45 as air exit apertures for conditioning the premises. In this event, only air for conditioning the premises which flows below the warp beam 21 or below the cloth beam 10 passes through into the weaving room or the corresponding operator gangway. When a number of weaving machines are present in a weaving room, room-conditioning air issues from the apertures 44 or 45 from only one machine into an operator gangway between the machine and the adjacent machine.

What is claimed is:

1. The combination with a weaving machine having a machine frame, a warp beam mounted at one end of said frame, a cloth beam mounted at an opposite end of said frame and means for directing warp yarns from said warp beam through a weaving plane to said cloth beam; a ventilation system comprising at least one air supply duct disposed below said weaving plane between said warp beam and said cloth beam, said duct having one set of apertures for directing a first flow of air below at least one of said warp beam and said cloth beam to an area outside and adjacent said respective end of said machine and a second set of apertures for directing a second flow of air into the interior of said machine below said weaving plane.

2. The combination as set forth in claim 1 wherein said duct is of triangular cross-section with a base, each said set of apertures being disposed at a respective vertex thereof.

3. The combination as set forth in claim 1 wherein said duct is a hollow bearing member of said machine frame.

4. The combination as set forth in claim 3 which further comprises at least one guide plate secured to said bearing member to separate said sets of apertures from each other.

5. The combination as set forth in claim 3 which further comprises an exhaust duct above said hollow bearing member and below said weaving plane for exhausting air from said interior of said machine.

6. The combination as set forth in claim 3 wherein said hollow bearing member is sub-divided into an air supply duct having said sets of apertures in communication therewith and an air exhaust duct having a third set of apertures in communication with said interior of said machine.

7. The combination as set forth in claim 3 wherein said bearing member has a horizontally disposed base and said one set of apertures is disposed in said base to direct flows of air below said warp beam and said cloth beam to areas outside and adjacent each respective end of said machine.

8. The combination as set forth in claim 1 which further comprises a deflector plate above said warp beam and below said weaving plane to direct a flow of air from said duct over the circumferential periphery of said warp beam.

9. The combination as set forth in claim 1 wherein said duct extends transversely of said weaving plane parallel to said warp m.

* * * * *

UNITED STATES PATENT AND TRADEMARK OFFICE

CERTIFICATE OF CORRECTION

PATENT NO. : 4,265,278

DATED : May 5, 1981

INVENTOR(S) : Kurt Jassniker

It is certified that error appears in the above—identified patent and that said Letters Patent is hereby corrected as shown below:

Column 4, line 48, change "m" to --beam--

Signed and Sealed this

*Eighteenth* Day of *August 1981*

[SEAL]

*Attest:*

GERALD J. MOSSINGHOFF

*Attesting Officer*

*Commissioner of Patents and Trademarks*